US008113013B2

(12) United States Patent
Kessler

(10) Patent No.: US 8,113,013 B2
(45) Date of Patent: Feb. 14, 2012

(54) JEWELRY ARTICLES WITH MAGNETS, AND KITS AND METHODS FOR USING AND MAKING THE SAME

(76) Inventor: June Kessler, Riverhead, NY (US)

( * ) Notice: Subject to any disclaimer, the term of this patent is extended or adjusted under 35 U.S.C. 154(b) by 90 days.

(21) Appl. No.: 10/933,579

(22) Filed: Sep. 3, 2004

(65) Prior Publication Data

US 2006/0048543 A1 Mar. 9, 2006

(51) Int. Cl.
*A44C 25/00* (2006.01)

(52) U.S. Cl. ..... 63/40; 63/3; 63/3.1

(58) Field of Classification Search ..... 63/900, 63/3.1, 3, 1.16, 1.17, 29.2, 40, 41; 24/574.1
See application file for complete search history.

(56) References Cited

U.S. PATENT DOCUMENTS

| | | | | |
|---|---|---|---|---|
| 3,481,155 | A | 12/1969 | Cook | |
| 3,509,734 | A * | 5/1970 | Lederer | 63/15 |
| 3,890,800 | A | 6/1975 | Montague | |
| 4,195,492 | A | 4/1980 | Johnson | |
| 4,783,974 | A | 11/1988 | Hernandez | |
| 4,912,944 | A | 4/1990 | Crosley et al. | |
| 5,007,252 | A | 4/1991 | Mochizuki | |
| 5,195,335 | A | 3/1993 | Hart | |
| 5,794,459 | A * | 8/1998 | Ignatowski | 63/38 |
| 5,806,346 | A * | 9/1998 | Schlinger et al. | 63/40 |
| 5,887,448 | A | 3/1999 | Gilbert et al. | |
| 6,014,871 | A * | 1/2000 | Romano | 63/41 |
| 6,381,985 | B1 | 5/2002 | Burgard | |
| 6,594,871 | B2 | 7/2003 | Hoffman | |
| 6,694,779 | B1 * | 2/2004 | Dreger | 63/33 |
| 6,715,315 | B1 | 4/2004 | Hartgrove | |
| 6,729,159 | B2 | 5/2004 | Rose | |
| 6,962,063 | B1 * | 11/2005 | Pearl | 63/3.2 |
| 6,981,391 | B2 * | 1/2006 | Suzuki | 63/3.1 |
| 2001/0017041 | A1 | 8/2001 | Tseng | |
| 2002/0112322 | A1 | 8/2002 | Hoffman | |
| 2002/0148251 | A1 | 10/2002 | Plumly | |
| 2003/0061689 | A1 | 4/2003 | Fuhrman | |
| 2003/0110798 | A1 | 6/2003 | Ignatowski | |
| 2004/0055332 | A1 | 3/2004 | Hartgrove | |
| 2004/0074259 | A1 | 4/2004 | Hartgrove | |
| 2004/0079111 | A1 | 4/2004 | Hartgrove | |
| 2004/0092788 | A1 | 5/2004 | Kaufman et al. | |
| 2004/0200043 | A1 | 10/2004 | Wong et al. | |
| 2004/0200236 | A1 * | 10/2004 | Emberson et al. | 63/23 |
| 2005/0148809 | A1 * | 7/2005 | Delaney | 600/15 |

FOREIGN PATENT DOCUMENTS

| | | |
|---|---|---|
| DE | 3416088 | 9/1986 |
| EP | 0714615 | 6/1996 |

* cited by examiner

*Primary Examiner* — Jack W. Lavinder

(57) ABSTRACT

The present invention provides inter-transformative jewelry articles, and kits and methods of making and using the same. Inter-transformative jewelry articles according to the present invention are adapted to change or transpose, expand or simplify, and attach or detach, wherein one shape or design or article or item becomes another shape or design or article or item by using diverse, interchangeable and adaptive parts.

5 Claims, 11 Drawing Sheets

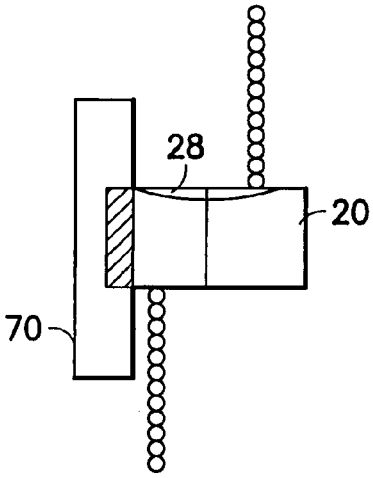
FIG.7
FIG.8A
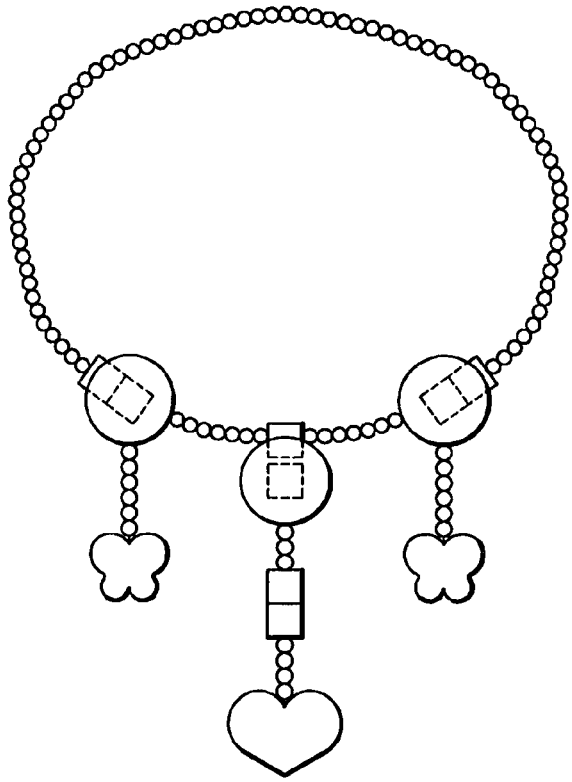
FIG.8B
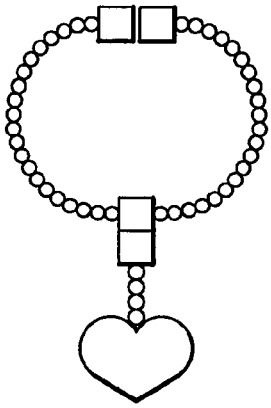
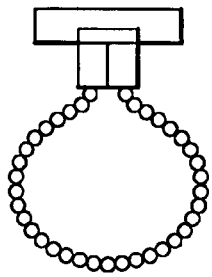
FIG.8C
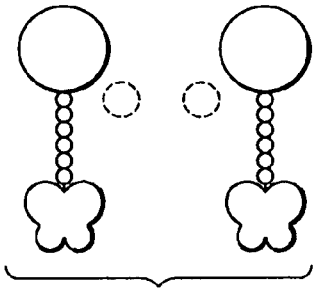
FIG.8D
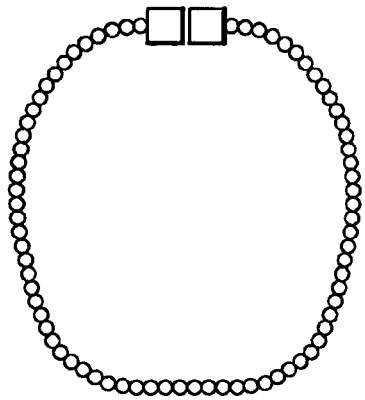
FIG.8E

JEWELRY ARTICLES WITH MAGNETS, AND KITS AND METHODS FOR USING AND MAKING THE SAME

BACKGROUND OF THE INVENTION

1. Field of the Invention

This invention relates to articles that are intended to be worn upon the person as ornaments. This invention is also related to fastenings comprising material utilizing magnetism.

2. Description of the Prior Art

Of the many types of ornaments that people use to decorate their bodies, some of the most popular types are beaded jewelry, charms, and pendants. Beaded jewelry, charms, and pendants are usually inexpensive, casual, and cute, which is appealing to everyone.

Like any other fashion market, due to ever-changing consumer demand, the market for beaded jewelry, charms, and pendants is under extreme pressure to constantly provide new designs to consumers. Continually providing fresh looks is both expensive in terms of development and manufacture, and risky because there can be no guarantee that the desired crowd of consumers will embrace any particular design.

Therefore, there is an ongoing need to provide new, desirable, and inexpensive beaded jewelry, charms, and pendants to consumers. In particular, and especially in light of the defining, but sometimes conflicting, human desires of treasuring the past and creating the future, there is an ongoing need to provide new, desirable, and inexpensive jewelry that can change and transform, attach and detach, and be expanded and simplified, so that previous pieces can still be used while new pieces can always be incorporated in ever changing designs envisioned and executed by the actual wearer.

Jewelry systems and convertible jewelry articles are known in the art. However, as discussed hereinbelow, prior art jewelry systems and convertible jewelry articles do not meet the above-identified consumer needs because the prior art jewelry systems are either proprietary, un-expandable, non-transformable, and/or limited in design or construction.

U.S. Patent Application Publication No. 2003/0110798 to Ignatowski describes a three-piece convertible eyeglass retainer/jewelry article. An article according to Ignatowski is convertible from an eyeglass retainer to multiple independent jewelry articles, such as a necklace, bracelet, dangling glass extension, or hair jewelry. Of course, the essential characteristic of the jewelry article of the Ignatowski publication is the eyeglass retainer. While one or two of the strands can be used as a necklace or bracelet, at least one of the strands is inevitably adapted for attachment with a temple arm of eyeglasses. Thus, the Ignatowski patent does not provide or even suggest true inter-transformation or inter-changeability.

U.S. Patent Application No. 2002/0148251 to Plumly describes a jewelry system including a locket clasp for conversion of a bracelet into a necklace. A jewelry finding according to Plumly is provided as a neck accessory with locket clasps and/or flexible loops at the ends thereof, which enables a flexible bracelet to be worn as a necklace. However, the clear shortcoming of the Plumly patent is the limited scope of the solution it provides. Specifically, the jewelry finding of the Plumly patent does not accommodate any other type of jewelry except bracelets. For example, the jewelry finding of the Plumly patent cannot be used with earrings, while using the jewelry finding with a necklace would be superfluous at best. Thus, the Plumly patent provides a narrow solution to a specific problem, and does not provide true inter-transformation where one design can be augmented or simplified to become a completely different design or item or article.

U.S. Pat. No. 6,014,871 to Romano describes a jewelry system including a necklace assembly having opposed end that are connectable to one another by releasably lockable primary finding components. The primary necklace assembly of the Romano patent comprises three pre-set pieces—a first bracelet component, a second bracelet component, and a pin component—that are attached together by auxiliary findings. Substantial design and construction effort is employed in order to make the auxiliary findings between the three components as "unobtrusive" as possible. In fact, while the primary findings of the Romano patent may be of "prior art" construction, the auxiliary findings are unusual and specific to the Romano patent, which means that the jewelry system of the Romano patent does not have free and unlimited inter-transformability and interchangeability. For example, due to the fact that the auxiliary findings of the Romano patent are not a general or common type of finding, it is clearly not possible to replace or interchange the pin component of the Romano patent with a pin component from a previous or future jewelry system.

U.S. Pat. No. 5,007,252 to Mochizuki describes a combination necklace that can be assembled in different configurations from separate necklaces of different or equal lengths. The Mochizuki patent provides only longer or shorter loops that are mechanically coupled together. In other words, the combination necklace of the Mochizuki patent can be a long necklace, a choker, a bracelet, an anklet, or any or loop-type jewelry article. However, the combination necklace of the Mochizuki patent is not adapted to become an earring, or a pendant, or some other type of non-loop jewelry. Also, the combination necklace of the Mochizuki patent cannot be augmented or enhanced with pendants, charms, or the like. Moreover, the Mochizuki patent does not disclose or even suggest the use of magnets. Thus, like the foregoing references, the combination necklace of the Mochizuki patent does not provide true inter-transformation where one design can be augmented or simplified to become a completely different design.

It is known in the art to provide magnet clasps to secure or close two ends of a jewelry article. For a recent example, U.S. Patent Application Publication No. 2003/0061689 describes a magnetic jewelry clasp comprising two bodies that each have a surface magnetically attracted to the other. It is also known in the art to provide jewelry with magnets for purported therapeutic effects. For a recent example, U.S. Patent Application Publication No. 2002/0173692 describes a magnetic key chain can be understood to be used on a living body, including around the wrist, around the arm, fingers, legs, ankles, and neck. Supposedly, a wide range of therapeutic benefits may be realized by wearing the magnetic jewelry at a variety of locations on the body.

It should be recognized, that using magnets as simple clasps or for their purported therapeutic effect clearly fails to full exploit the versatility of magnets.

It should be further recognized that each prior reference provides for, and requires, the retention of the original form despite a possible change in use, resulting in a mere connection in a different way without inter-transformation.

SUMMARY OF THE INVENTION

In light of the foregoing, the present invention provides inter-transformative jewelry articles, and kits and methods of making and using the same. Essentially, inter-transformative jewelry articles according to the present invention are adapted to change or transpose, expand or simplify, and attach or detach, wherein one shape or design or article or item becomes another shape or design or item or article by using diverse, interchangeable parts. In one preferred embodiment, a jewelry article according to the present invention comprises a filament or elongated member, a magnet threaded on or attached to the filament, and a plurality of ornamental items.

In another preferred embodiment, a jewelry article according to the present invention comprises one or more of a plurality of magnets or a band of magnetic material, without a filament or elongated member, wherein the magnets are releasably, magnetically attached to each other in various and diverse shapes and designs.

In either preferred embodiment, at least one magnet is preferably adapted for releasable magnetic connection with a dangle, pendant, necklace, charm, and/or decorative cover piece or item or article.

Depending upon its form, jewelry articles according to the present invention may also comprise a magnetic or non-magnetically coupled clasp (i.e., for a necklace, etc.), a magnetic or non-magnetically coupled hook (i.e., for an earring), a magnetically or non-magnetically coupled pin (i.e., for a broche), or another suitable closure and/or attachment device for user convenience. Alternatively, jewelry articles according to the present invention may comprise a band or loop, whereby using a closure and/or attachment device would be unnecessary. Dangles, pendants, charms, belly button clasps, other non-piercing body jewelry and/or any other adaptive covers according to the present invention preferably comprise at least one magnet adapted for releasable magnetic connection with the jewelry article. In this manner, the present invention provides easy adaptation for a wide array of adaptive designs, articles, items, or jewelry or art products.

BRIEF DESCRIPTION OF THE FIGURES

FIG. 7 is a side view of a jewelry article showing a magnet and cover assembly;

FIG. 8A is a jewelry article according to the present invention showing a combination of several significant aspects of the present invention, namely connectability, layering, and a variety of ornaments;

FIG. 8B is a component of jewelry article 8A transformed into a bracelet with a dangle;

FIG. 8C is a component of jewelry article 8A transformed into a pair of magnetic earrings;

FIG. 8D is a component of jewelry article 8A transformed into a ring with a magnet cover;

FIG. 8E is a component of jewelry article 8A transformed into a simple necklace;

DESCRIPTION OF THE INVENTION

Specific features and advantages offered by the present invention are described hereinbelow in reference to several preferred embodiments. Specifically, a first preferred embodiment is discussed in reference to FIGS. 1 to 5. A second preferred embodiment is discussed in reference to FIGS. 6 to 8. An additional preferred embodiment is discussed in reference to FIG. 9 discussing magnetic attachment. The following preferred embodiments have certain particular features and advantages, but jewelry articles according to the present invention may nonetheless have nearly innumerable configurations, and the present invention is not limited to any preferred embodiment. Moreover, while the preferred embodiments described hereinbelow all make use of magnets, the present invention contemplates that the inter-connection of the various components and ornaments used in the present invention may be accomplished using other releasable means, such as clips, hook-and-loop closures, and even non-permanent glue.

Figure 1:
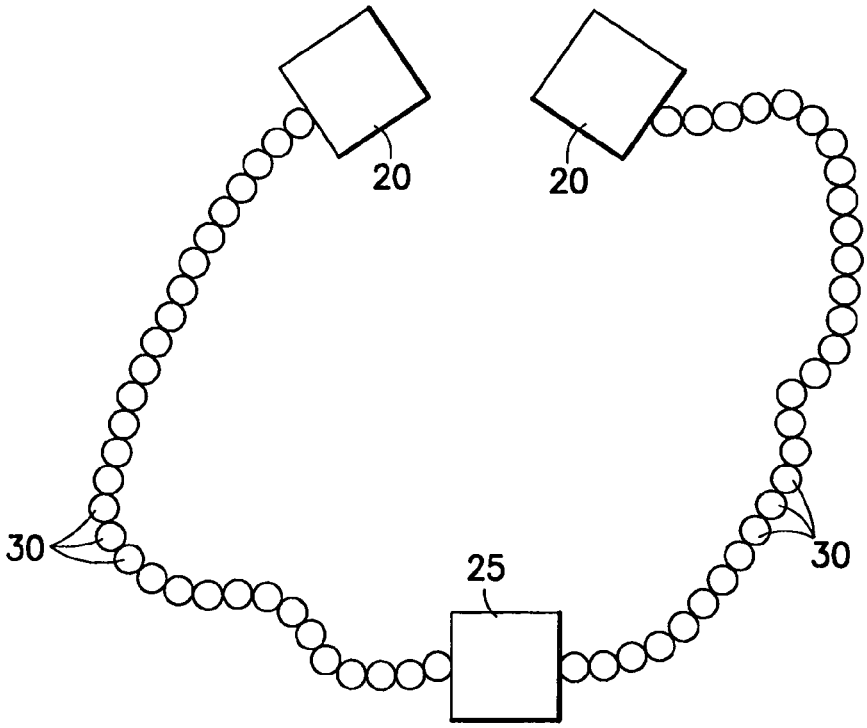
FIG. 1 shows a jewelry article according to the present invention, wherein the jewelry article is a necklace.
Figure 1A:
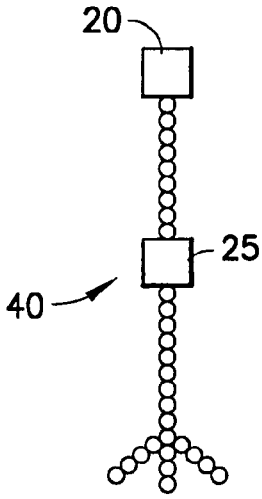
FIG. 1A shows a dangle jewelry article as one example of one embodiment of the present invention.
Figure 1B:
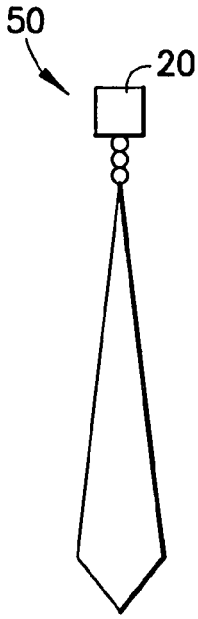
FIG. 1B shows a pendent jewelry article as another example of one embodiment of the present invention.
Figure 1C:
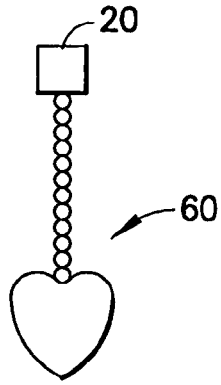
FIG. 1C shows a charm jewelry article as another example of one embodiment of the present invention.
Figure 1D:
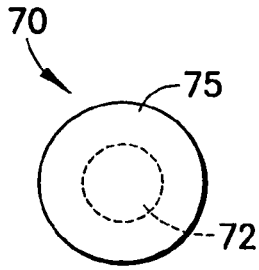
FIG. 1D shows a magnet cover according to another embodiment of the present invention.

Referring to FIGS. 1, 1A, 1B, 1C, and 1D, there is shown a first preferred jewelry article according to the present invention. The jewelry article of FIG. 1 is a necklace. The necklace comprises a filament (elongated member) 10 (see FIG. 2) and a variety of beads 30. Significantly, the necklace comprises a plurality of magnets. As described hereinafter, the magnets are either terminal magnets 20 or intermediate magnets 25. The first intermediate magnet (25) is attached to said elongated member between the two ends. The first intermediate magnet includes a magnetic axis extending from the positive pole to the negative pole of the first intermediate magnet, a central axis extending substantially perpendicular to the magnetic axis and a channel (26) extending through and centered along the central axis of said first intermediate magnet, wherein the elongated member (10) extends through the channel to rotationally support said first intermediate magnet between the ends of the elongated member. Those skilled in the art should readily understand, that while terminal and intermediate magnets (20, 25, etc.) are discussed in various embodiments and shown in various polarity orientations; the invention is not limited to the particular embodiments shown. It should be understood, that terminal and intermediate magnets, or other magnatizable materials (e.g., steel, etc.) used in lieu thereof, may be interchanged and re-positioned in alternative magnetic orientation to provide for additional adaptive embodiments.

Filament 10 may be made from any suitable structure or material, for example a metal wire, string, rope, leather, fabric strips, thread, rubber strands, or elastic material. Filament 10 may be flexible, semi-rigid, or rigid. For example, a necklace according to the present invention could use a flexible filament, while a bracelet could use a semi-rigid filament, and a barrette or hair-comb could use a rigid filament. Beads 30 have distinctive shapes, but are not limited to any specific shape. Beads 30 may be made from any suitable type of material, including glass, metal, clay, polymers, stone, bone, and natural substances, such as nuts, seeds, wood, shells, plastic, paper, fabric, or leather.

Terminal magnets 20 and intermediate magnets 25 are adapted for releasable magnetic connection with each other or with an ornament, which may be, for example, a dangle 40, pendant 50, charm 60, or cover 70. As discussed in further detail hereinbelow, ornaments for the present invention are practically unlimited in variation, and may be adapted as inter-transformational jewelry items, such that the ornament may be formed into several shapes or designs. For example, a dangle may be inter-transformed into a ring, bracelet, etc.

Terminal magnets 20 and intermediate magnets 25 may be any suitable shape, including cubes, cylinders, discs, cones, pyramids (see FIG. 6A), stars, hearts, etc. Magnets 20 and 25 are preferably neodymium, but may be any suitable material, including, without limitation, hematite, steel, or a ferro-magnetic material. Neodymium is one preferred material for magnets 20 and 25 because it provides a relatively stronger magnetic field by weight, which allows for longer and/or heavier ornaments to be attached thereto. It is recognized that additional materials (other rare earth metals, etc.) may also be used to generate the magnetic field. A stronger magnetic field also provides a more secure connection between pairs of magnets, whereby ornaments are less likely to drop off of the jewelry article.

A jewelry article according to the first preferred embodiment of the present invention will comprise at least one intermediate magnet 25 (see FIG. 2) and may comprise two or more terminal magnets 20. As shown in FIG. 1, a pair of terminal magnets 20 may be used as a clasp and the remaining intermediate magnets 25 are used for magnetic connection with a dangle 40, pendant 50, charm 60, or cover 70. Alternatively, jewelry articles according to the first preferred embodiment of the present invention may be provided with a more conventional clasp (not shown), whereby using a pair of terminal magnets as a clasp would be unnecessary.

As described in further detail hereinafter, dangles 40, pendants 50, and charms 60, according to the present invention may adaptively comprise at least one terminal magnet 20, layer magnet 28, intermediate magnet 25, or other magnetic item adapted for optional, releasable magnetic connection with related terminal, layer, or intermediate magnets (20, 25, 28), or a flexible magnetic band portion on the jewelry article.

Magnet covers 70 according to the present invention will comprise a base magnet 72 and a cover element 75. In various adaptive embodiments, magnet cover 70 may or may not comprise a filament in comparison to dangles 40, pendants 50, and charms 60, or other articles or items. In a similar manner, beads 30, cover element 75 may be any suitable materials (e.g., plastic, rhinestones, etc.) and any aesthetic shape (e.g., flowers, domes, cones, pyramids, stars, hearts, moons, etc.). In the present discussion, it should be understood, that magnet covers 70 and other items and articles of the present invention may include adaptive covers 75, for example in the shape of a flower, and this cover may itself be made from a magnet or a magnatizable material.

Ornaments useful in the present invention are not limited to fashionable or trendy materials and aesthetics. In fact, ornaments useful in the present invention may be very refined (e.g., precious and/or semi-precious stones and metals) or just plain fun (e.g., toys, letters, and animal shapes), or anything in between. Each ornament includes a terminal magnet (25) having a magnetic axis extending from the positive pole to the negative pole of the terminal magnet, a central axis extending substantially parallel to the magnetic axis, a channel (21) extending through and centered along the central axis of the terminal magnet, and an ornamentation (30, 30') having a second elongated member (10') extending through the channel securing the ornamentation to said terminal magnet.

Figure 2:
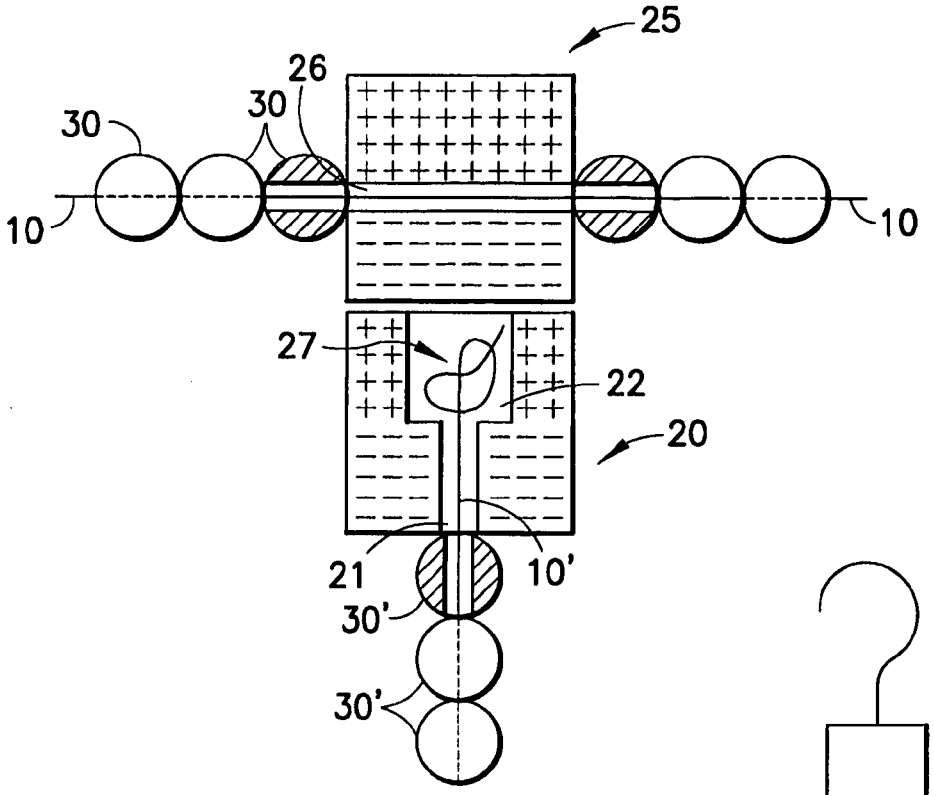
FIG. 2 is a cut-away detail view of the magnet, filament, and beads of the jewelry article of FIG. 1.
Figure 3:
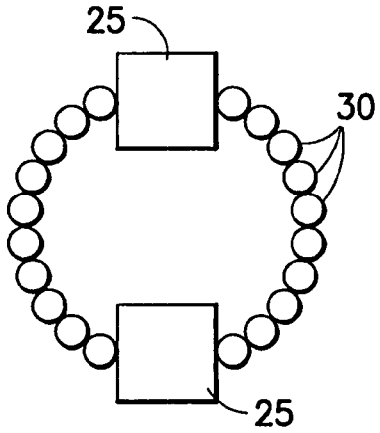
FIG. 3 shows a jewelry article according to the present invention, wherein the jewelry article is a ring.
Figure 4:
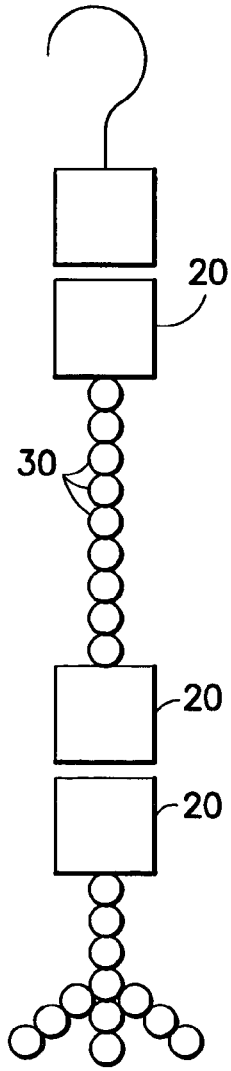
FIG. 4 shows a jewelry article according to the present invention, wherein the jewelry article is a drop-style earring.

Referring to FIG. 2, there is shown a detail view of an ornament in the form of a dangle 40 connected to a jewelry article. The detail view of FIG. 2 is a cut-away view to show how the various magnets and beads are interconnected. It should be understood, that while FIG. 2 is presented for the present description, the polarity shown is not restrictive and may be otherwise adapted and position depending upon a user's and designer's preference or a particular shape, item, or article employed in the design.

As shown, filament 10 of the jewelry article extends through beads 30 and intermediate magnet 25. A second filament 10' underpins dangle 40, and extends through the beads 30' thereon. The second filament 10' terminates in a terminal magnet 20. As is shown in FIG. 2, terminal magnet 20 and intermediate magnet 25 have respective channels 21 and 26, through which extend their respective filaments. In terminal magnet 20, channel 21 ends at a recess 22, which is the significant difference between the structure of a terminal magnet 20 and an intermediate magnet 25. It is noted that those skilled in the art should also recognize that terminal and intermediate magnets may be switched, used as replacements according to adaptive interpretations of the present invention, or repositioned along the length of filament to enable new designs, articles, or items.

As shown in the present embodiment, the end of filament 10' is finished with a knot 27 or another suitable end so that filament 10' cannot be pulled out of terminal magnet 20, and recess 22 is provided so that knot 27 does not protrude out of terminal magnet 20.

A significant and advantageous feature of the present invention is the ability to combine several jewelry articles and ornaments to make innovative and fresh designs. In fact, the present invention provides an enormous variation of jewelry articles, including (but not limited to) finger rings (see FIG. 3), earrings (see FIG. 4), nipple rings, nose rings, belly rings, toe rings, wrist bracelets, ankle bracelets, chokers, necklaces (see FIG. 1), headbands, barrettes, belts (see FIG. 5), watches, shoe buckles, pocket book straps, decorations, faux (and actual) body piercings, and adaptive combinations of the same (e.g., a nose ring+necklace combo), and so on.

It should be recognized by those skilled in the art that employing the present invention in alternative embodiments may allow a user to adaptively connect body parts via jewelry. For example, a user may connect a nose ring with a magnetic earing, with a belly button article simultaneously. In a second example, a user may attach a belt or choker to a nipple or nose ring or in other combinations dependent upon a user's selections.

Figure 5:
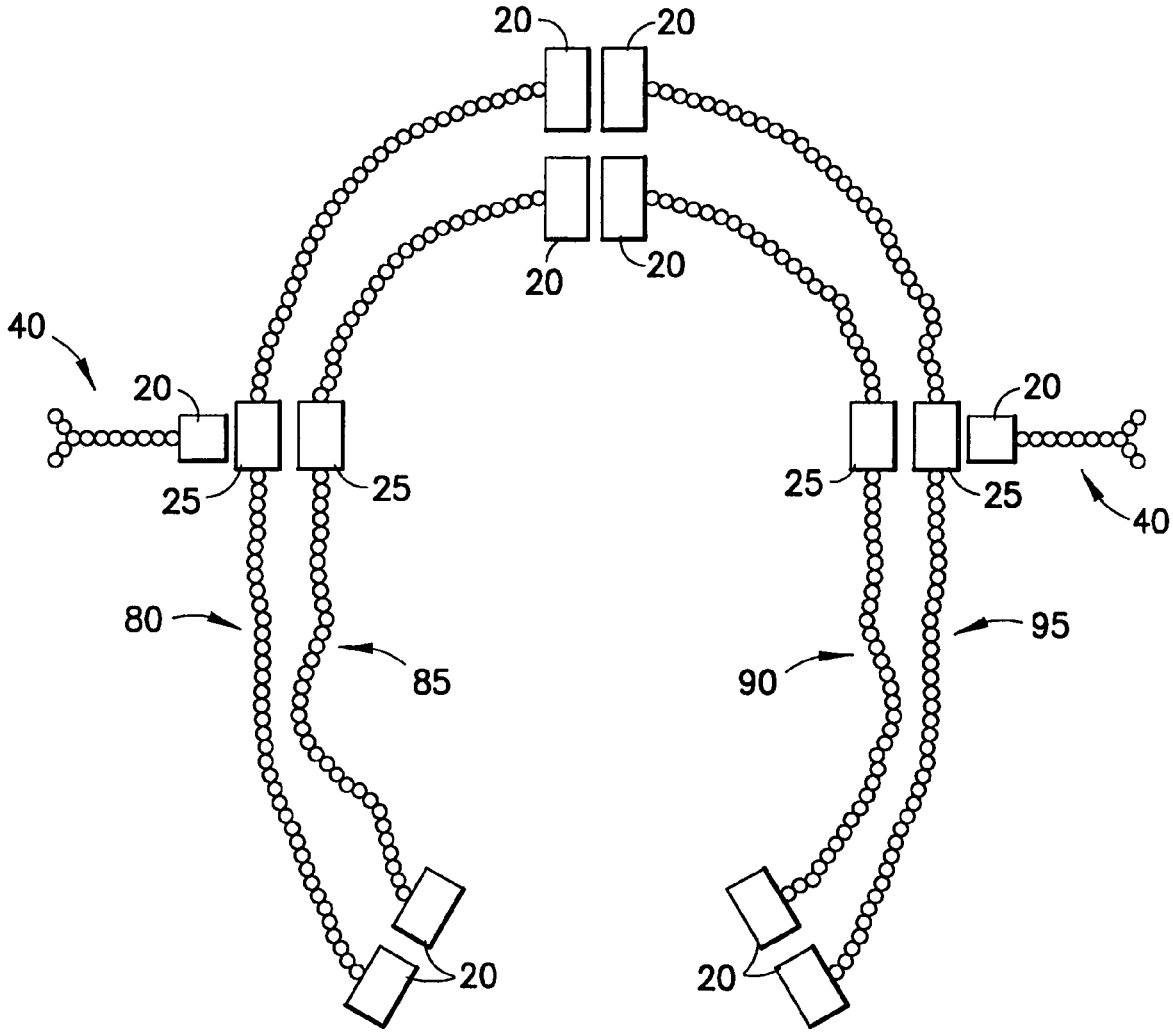
FIG. 5 shows a pair of jewelry articles according to the present invention, wherein the jewelry articles are connected and configured as an article of apparel, which is a belt.

Referring to FIG. 5, as a specific example of the variety of designs provided by the present invention, there is shown a belt that comprises four magnetically connected jewelry articles 80, 85, 90, and 95. As illustrated in FIG. 5, jewelry articles according to the present invention are adapted to be used independently as well as together. In fact, a user is neither limited to number of jewelry articles that can be used together, nor the resulting configuration of the jewelry articles that are used.

Figure 6A:
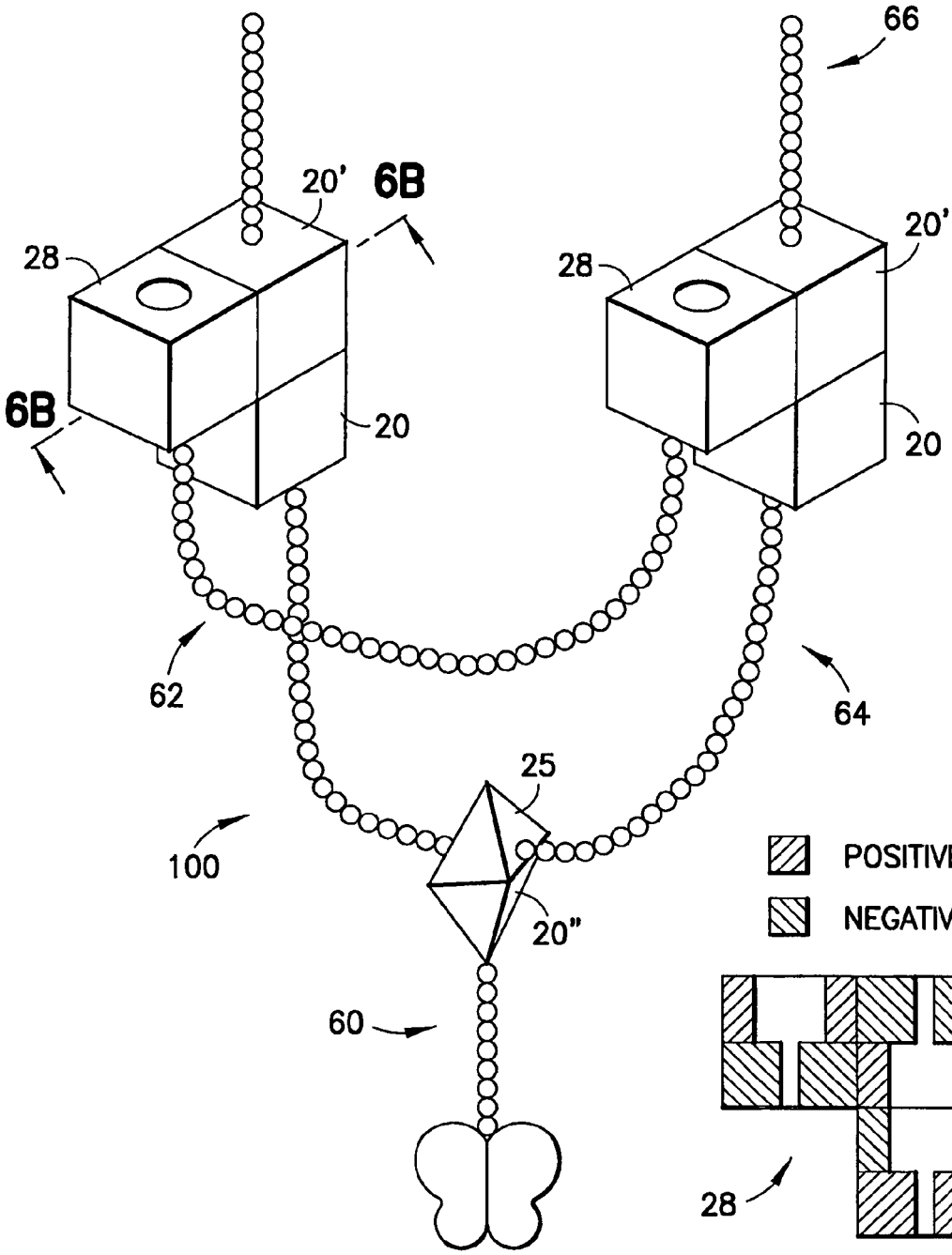
FIG. 6A shows a multi-layered jewelry article according to the present invention.
Figure 6B:
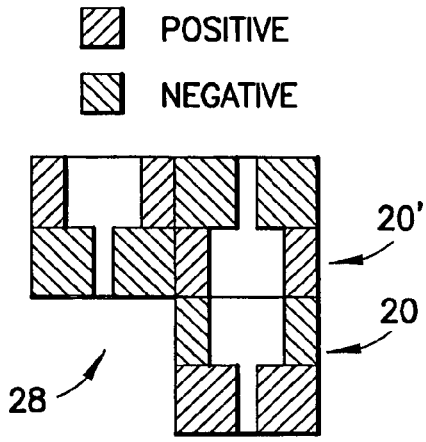
FIG. 6B is a cross-section view of a group of magnets showing their respective, specific polarities.

Referring to FIGS. 6A and 6B, there is shown a second preferred embodiment, which is indicated generally as reference numeral 100, of a jewelry article according to the present invention. Significantly, jewelry article 100 comprises layered magnets 28 in addition to terminal magnets 20 and intermediate magnets 25, which are described hereinabove. For the sake of clarity, in FIGS. 6A and 6B, terminal magnets 20 of jewelry component 64 are distinguished from terminal magnets 20' of jewelry component 66 and terminal magnet 20" of pendant 60, even though terminal magnets 20, 20', and 20" are substantially identical in form and use and, according to adaptive embodiments may be magnets 25, 28 while retaining the present creative function provided by the invention.

As shown specifically in FIG. 6B, by providing magnets 20, 20', and 28 with specific polarities, it is possible to layer those magnets, in addition to merely connecting them end-to-end. Thereby, jewelry article 100 may be designed in several dimensions or directions. It is again noted, that the polarities shown are suggestive only, and where for example magnet 28 is placed in a different orientation, or is made in a different shape. In sum, the polarity orientation may be adapted to suit a particular user's need or desire without departing from the scope and spirit of the present invention.

Referring again to FIG. 6A, jewelry article 100 comprises jewelry components 62, 64, and 66. The terminal magnets 20' of jewelry component 66 are magnetically connected to respective terminal magnets 20 of jewelry component 64 is a substantially conventional end-to-end manner. Moreover, the layered magnets 28 of jewelry component 62 are magnetically connected to respective terminal magnets 20' is a substantially side-to-side manner. By optionally and alternatively connecting the magnet in end-to-end and/or side-to-side manners, jewelry article 100 has a depth or width that has heretofore not been provided by conventional jewelry systems. In addition, referring to FIG. 7, because all the ornaments discussed above in reference to the first preferred embodiment of the present invention are equally useful with the second preferred embodiment, given cover 70 with magnet 72 having the appropriately specific polarity, layered magnet 28 may itself be layered upon, wherein cover 70 is magnetically connected side-to-side with layered magnet 28, which is, in turn, magnetically connected side-to-side with terminal magnet 20.

As shown in FIG. 8, with the additional feature of layered magnets, the second preferred embodiment of the present invention is even more flexible, adaptable, changeable, transformable, enhanceable, simplifiable, attachable, and detachable, than the first preferred embodiment, which is already rich with possibilities. The highly ornamented necklace of FIG. 8A, is composed of a bracelet (FIG. 8B), magnetic earrings (FIG. 8C), faux lip/nose piercings, a ring (FIG. 8D), and a choker necklace (FIG. 8E).

Figure 9A:
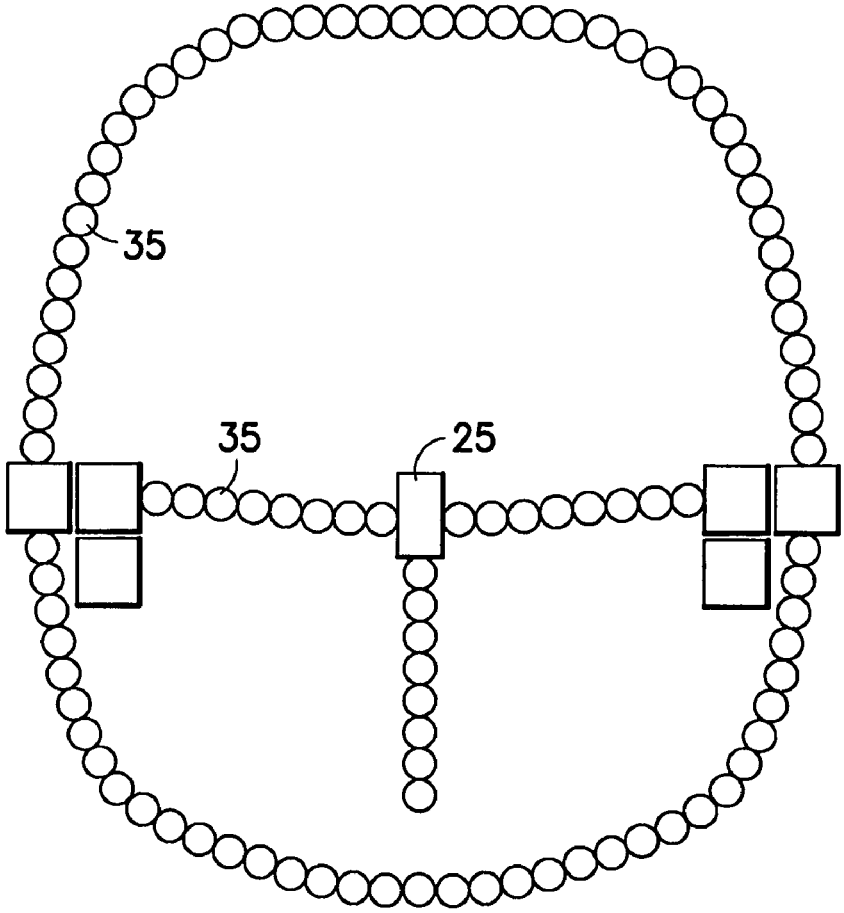
FIG. 9A is a jewelry article according to the present invention that does not require a base element (i.e., a filament) to hold the individual bead elements together.
Figure 9B:
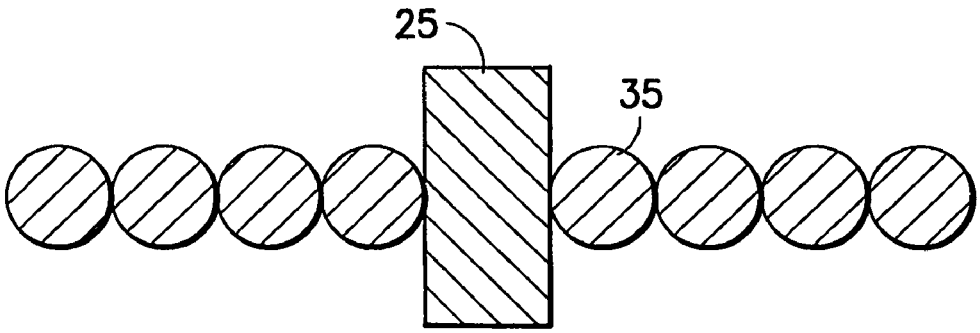
FIG. 9B is a partial sectional view of FIG. 9B showing the non-filament magnetic connection through the components.

Referring to FIGS. 9A and 9B, there is shown a third preferred embodiment of the present invention wherein, due to the strong magnetic quality of individual bead elements 35, no base element (i.e., a filament) is required to hold individual bead elements 35 together. The features and advantages of the present invention as described hereinabove are still provided by the third preferred embodiment, with the exception of a filament or the through-holes, channels, and recesses necessary to accommodate such a filament. By completely removing the constraint of a filament (as best shown in the cut-away FIG. 9B showing continuous cross-sections), the third preferred embodiment further improves on the underlying advantages of the present invention, namely a practically unlimited ability to transform into various jewelry components. It should be understood, that adaptive embodiments of the present invention may replace the filament and or the magnets with a continuous or segmented flexible magnetic strip (i.e. flexible magnets) that enables the easy placement, replacement, and transformative-use of any design with a variety of components in the same spirit and scope as the above discussion. It should be further understood, that while individual bead elements 35 are shown in a generally rounded form, alternative embodiments are envisioned, including interlocking geometric shapes or any other shape (each individually magnets or magnatizable materials (e.g. steel) formed to create designs without filaments.

Figure 10:
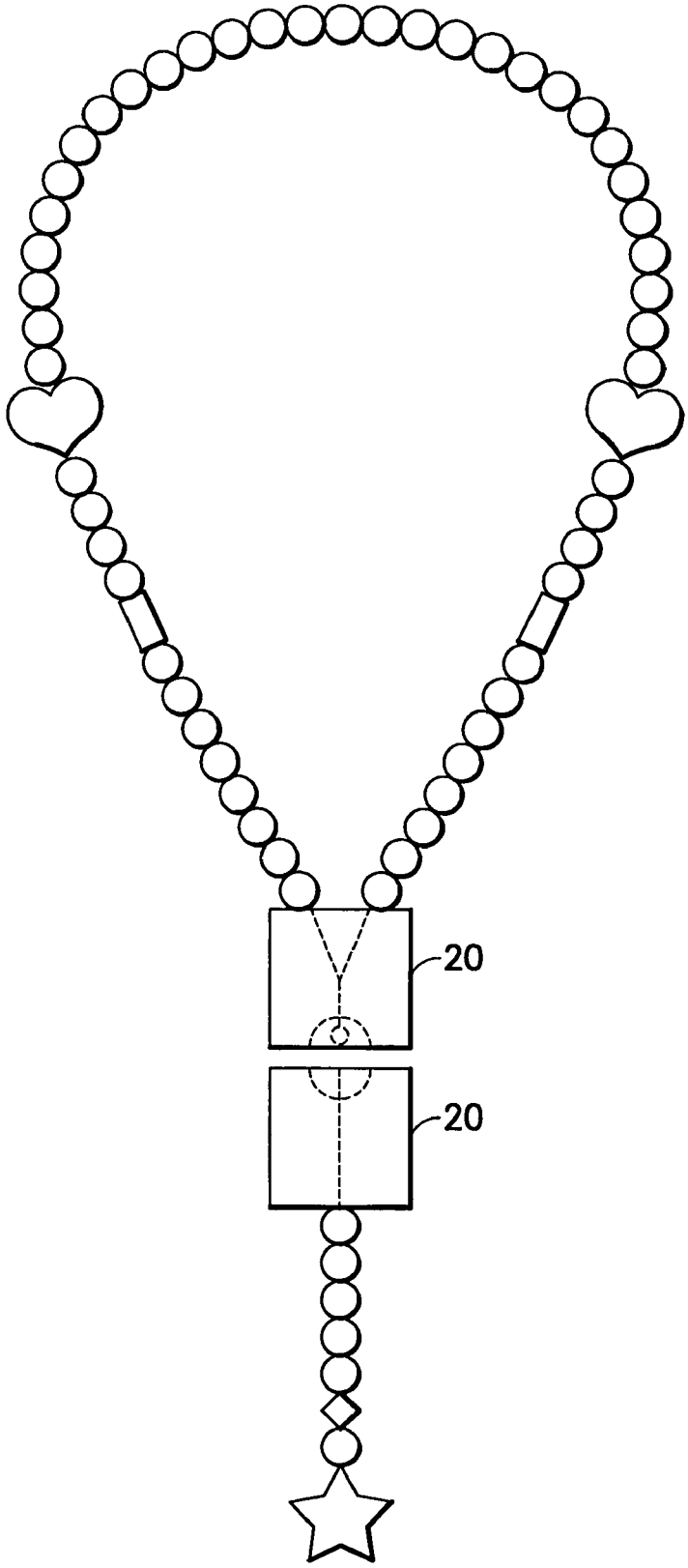
FIG. 10 is an alternative embodiment of the present invention noting the use of terminal magnets along the length of a jewelry item allowing oriented (horizontal, vertical, dangle, drooped) positioning.

As will be discussed below, additional alternative and adaptive embodiments of the present invention are provided in additional FIGS. 10-14. FIG. 10 emphasizes the ready adaptability of the present invention to positioning a terminal magnet 20 along a continuous chain allowing ready attachments of additional items, dangles, designs, etc. The benefit of the present design, is that terminal magnet 20, employing its present polarity may be positioned in multiple positions along the length of, for example, a necklace creating additional attachment points.

Figure 11:
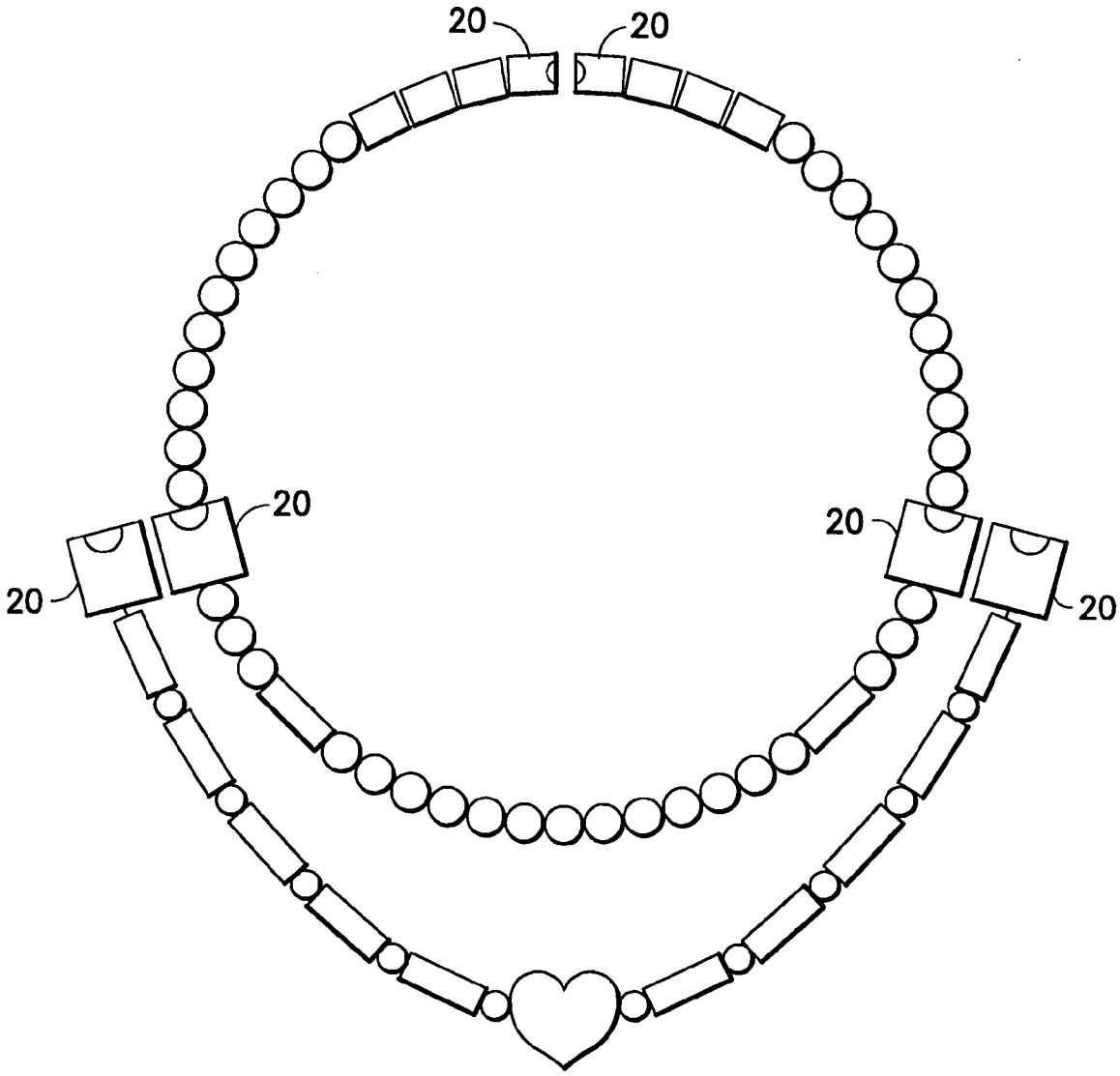
FIG. 11 is another alternative embodiment of the present invention suggesting one use in a layering effect.

FIG. 11 discloses other adaptive positioning for terminal magnets 20, allowing smooth layering or multi-layering of designs, items, or articles. The present embodiment makes clear that a user can easily adapt the present invention to a variety designs employing terminal magnets within a first strand while others at the end of a member.

Figure 12:
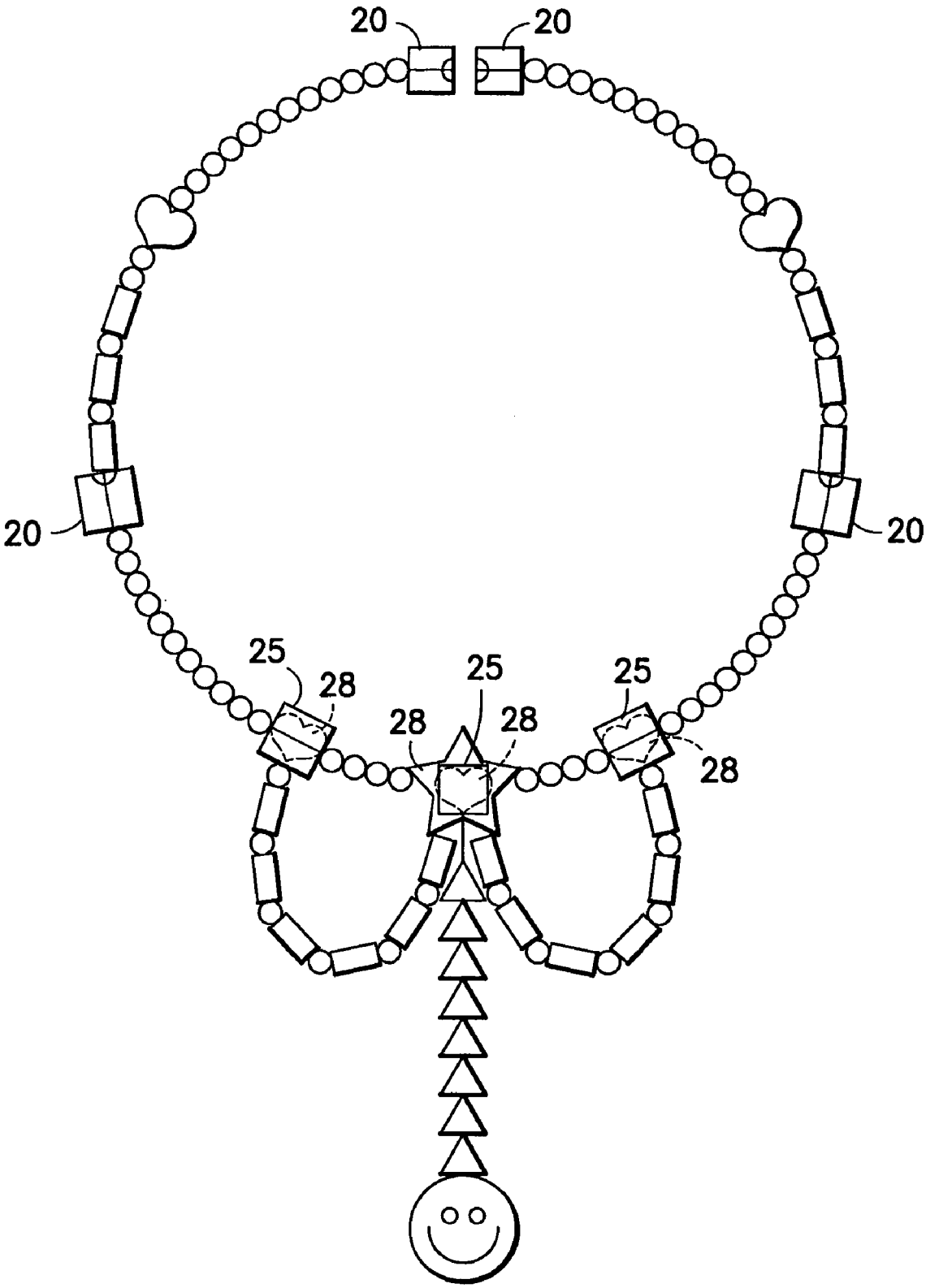
FIG. 12 is another alternative embodiment of the present invention noting the capacity of multiple layers, intermediate magnetic items, decorative features, and other items.

FIG. 12 discloses a more complex adaptive positioning of terminal magnets 20, intermediate magnets 25, and multiple layered magnets or magnet layer groups 28. As is readily apparent from the design, a user can easily benefit from the unique polarity and forms of the various components in an adaptive design allowing the incorporation of multiple components in a final piece.

Figure 13:
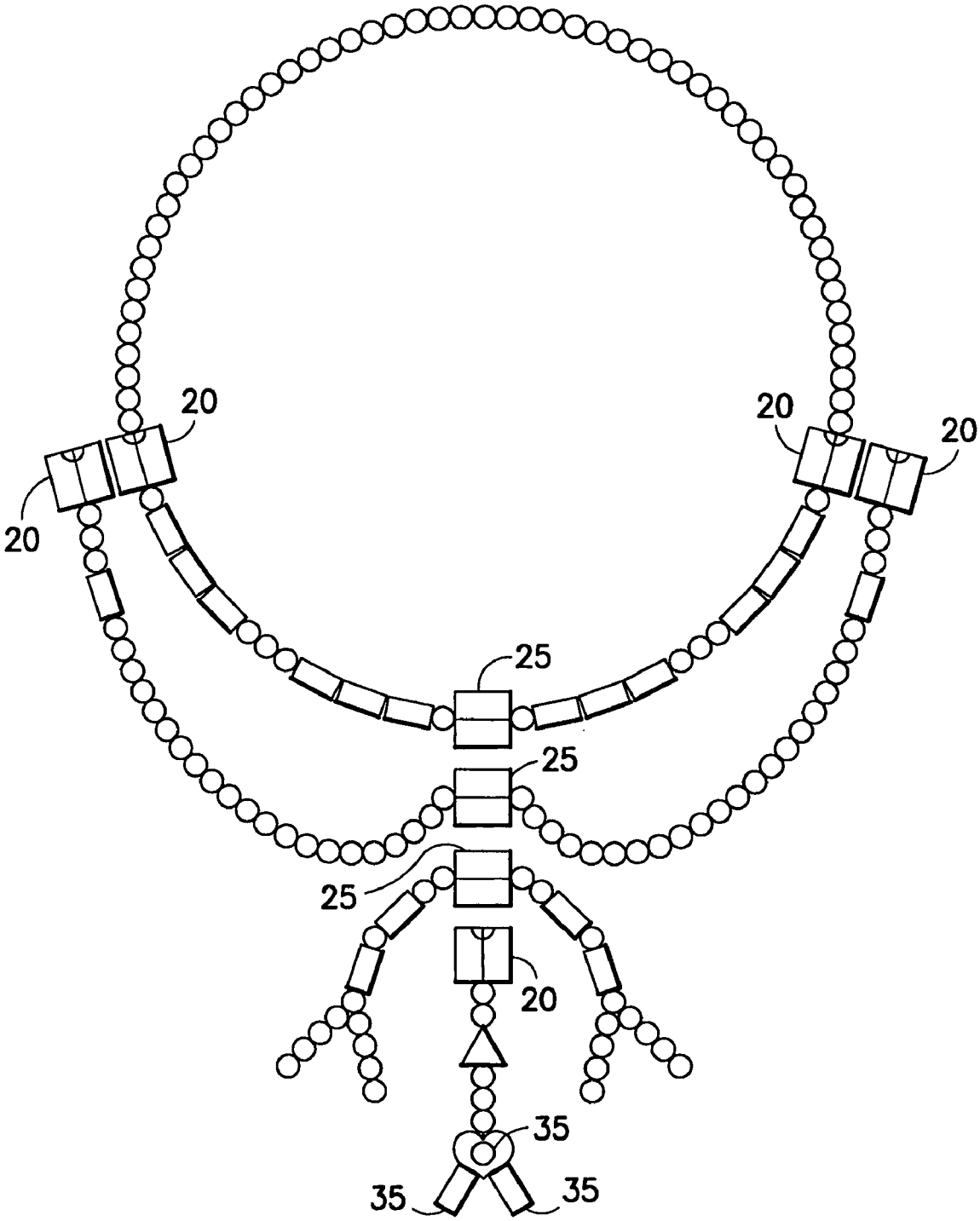
FIG. 13 is another alternative embodiment of the present invention suggesting the combination of layering designs and individual decorative bead elements in combination with multiple magnets.

FIG. 13 discloses yet a further design employing multiple layers of design and multiple individual bead elements 35 in combination with terminal and intermediate magnets 20, 25. As can be seen from this further representative example, layered, multi-layered, and dangled designs are easily created without departing from the scope and spirit of the present invention.

Figure 14:
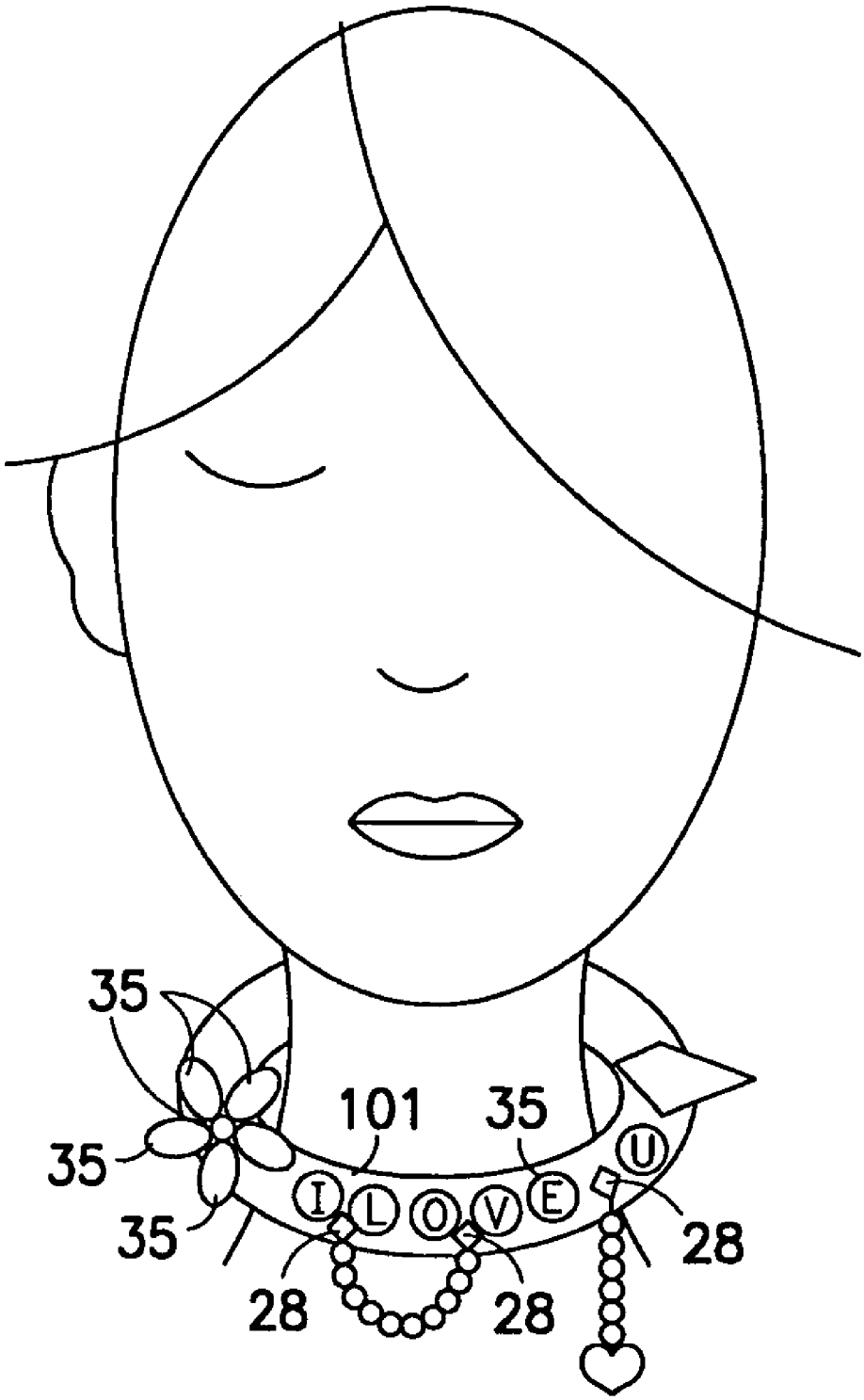
FIG. 14 is another alternative embodiment of the present invention suggesting the use of a flexible magnetic member to replaceably receive multiple individual bead elements and layered magnets with dangles, loops, and other designs.

FIG. 14 discloses yet a further embodiment of the present invention employing multiple magnetic individual elements 35, magnet layered items 28, positioned on a continuous flexible magnetic strap or band 101. As discussed above, a flexible magnetic strap or band 101 may be used in place of a filament or non-filament multiple magnet band. As is readily apparent to those skilled in the art, the present invention allows the ready replacement of and creative designs using multiple individual decorative elements.

The present invention also contemplates systems or kits for making the jewelry articles described hereinabove. Jewelry kits according to the present invention are preferably complete craft kits, comprising magnets, beads, and other materials and articles sold in a single package and intended for use to create a finished magnetic jewelry fashion article. The kits would include a plurality of items useful for making the jewelry articles, including individual filaments, individual magnets with or without specific polarity, and any individual, interchangeable, jewelry components, such as dangles, with or without magnets, as well as satin pouches, plastic containers, beads-in-a-bottle, and bottles with corks, etc. The end user makes a jewelry article in accordance with instructions provided in the kit.

It should be recognized by one skilled in the art, that in one preferred embodiment, a jewelry article according to the present invention comprises a filament or elongated member, a magnet threaded on or attached to the filament, and a plurality of ornamental items. In another preferred embodiment, a jewelry article according to the present invention comprises a plurality of magnets without a filament or elongated member, wherein the magnets are releasably, magnetically attached to each other or to various parts of a use's body (e.g., an earring, etc.) in various and diverse shapes and designs. In either preferred embodiment, at least one magnet is preferably adapted for releasable magnetic connection with various ornaments, such as a dangle, pendant, charm, and/or decorative cover piece, or other drape-able or scoop item, or combinations thereof in any draping or non-draping form in either a vertical or horizontal orientation or combination thereof.

It should be further understood, that depending upon its form, jewelry articles according to the present invention may comprise a clasp (i.e., for a necklace), a hook (i.e., for an earring), a pin (i.e., for a broche), or another suitable closure and/or attachment device. Alternatively, jewelry articles according to the present invention may comprise a band or loop, whereby using a closure and/or attachment device would be unnecessary. Ornaments, such as dangles, pendants, charms, and/or covers, according to the present invention preferably comprise at least one magnet adapted for releasable magnetic connection with the jewelry article or a magnatizable material or material attractable to a magnet, including wherein the magnet is in the form of a continuous flexible magnetic member adapted to join with other magnetic or non-magnetic members.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A jewelry article comprising:

an elongated member having two ends, a first intermediate magnet attached to said elongated member between the said two ends, said first intermediate magnet including a magnetic axis extending from the positive pole to the negative pole of said first intermediate magnet, a central axis extending substantially perpendicular to the magnetic axis and a channel extending through and centered along the central axis of said first intermediate magnet, wherein the elongated member extends through the channel to rotationally support said first intermediate magnet between the ends of the elongated member;

a plurality of ornaments wherein each ornament includes a terminal magnet having a magnetic axis extending from the positive pole to the negative pole of the terminal magnet, a central axis extending substantially parallel to the magnetic axis, a channel extending through and centered along the central axis of said terminal magnet, and an ornamentation having a second elongated member extending through the channel securing the ornamentation to said terminal magnet; and, wherein a user can selectively remove and replace the ornaments onto said first intermediate magnet and wherein said intermediate magnet can rotate on said central axis from the magnetic torque placed upon it from the terminal magnet in order to magnetically couple one of the ornaments with the terminal magnet to the first intermediate magnet.

2. The jewelry article of claim 1, wherein the ornaments are selected from the group consisting of dangles, pendants, charms, covers, beads, finger rings, earrings, nipple rings, belly rings, toe rings, wrist bracelets, ankle bracelets, necklaces, chokers, headbands, barrettes, belts, precious stones, semi-precious stones, precious metals, semi-precious metals, glass, metal, clay, polymers, stone, bone, nuts, seeds, wood, shells, plastic, paper, fabric, leather, cubes, cylinders, discs, cones, pyramids, stars, hearts, animal shapes, letters, toys, pocket-book-straps, watch bands, faux piercings, alpha-numeric characters, an combinations thereof.

3. The jewelry article of claim 1, wherein the intermediate magnet is neodymium.

4. A jewelry article of claim 1 where the intermediate magnet is a cuboid shape.

5. A jewelry article of claim 1 where the magnetic ornaments have one or more terminal ends.

* * * * *